United States Patent [19]

Schmitz, II et al.

[11] Patent Number: 4,979,338

[45] Date of Patent: Dec. 25, 1990

[54] CRYOGENIC DEFLASHING APPARATUS AND METHOD OF USE

[75] Inventors: Robert E. Schmitz, II, Oceanside; David T. Stearns, Irvine, both of Calif.

[73] Assignee: Airmac Cryogenic Systems, Inc., Costa Mesa, Calif.

[21] Appl. No.: 316,997

[22] Filed: Feb. 28, 1989

[51] Int. Cl.[5] ..... B24C 3/30

[52] U.S. Cl. ..... 51/423; 51/322; 51/426; 51/433

[58] Field of Search ..... 51/423, 422, 419, 433, 51/434, 432, 322, 320

[56] References Cited

U.S. PATENT DOCUMENTS

| | | | |
|---|---|---|---|
| 2,116,160 | 5/1938 | Rosenberger et al. | 51/426 |
| 2,351,453 | 6/1944 | Pearl | 51/422 |
| 2,996,846 | 8/1961 | Leliaert | 51/322 |
| 3,298,138 | 1/1967 | McCormick, Jr. | 51/423 |
| 4,030,247 | 6/1977 | Grund | 51/419 |
| 4,089,138 | 5/1978 | Thomson | 51/422 |
| 4,355,488 | 10/1982 | Schmitz et al. | 51/319 |
| 4,524,548 | 6/1985 | Klee | 51/322 |
| 4,646,484 | 3/1987 | Brull | 51/322 |

FOREIGN PATENT DOCUMENTS

| | | | |
|---|---|---|---|
| 0102756 | 6/1982 | Japan | 51/419 |

OTHER PUBLICATIONS

Cryogenic Information Report of May, 1987, p. 23 with abstracts.

*Primary Examiner*—Robert A. Rose
*Attorney, Agent, or Firm*—Stetina and Brunda

[57] ABSTRACT

A cryogenic deflashing apparatus is disclosed specifically adapted to rapidly remove residual flash from molded articles. The cryogenic deflashing apparatus incorporates a novel throw wheel assembly formed as a pump to create a vacuum utilized to continuously recirculate blasting media within the deflashing chamber. The throw wheel is powered by a pneumatic motor the exhaust of which is supplied to the intake port of the throw wheel to pre-accelerate the blasting media onto the throw wheel as well as supplement the magnitude of vacuum lift of the blasting media into the throw wheel. An article basket and basket drive mechanism is disposed within the deflashing chamber and includes biasing seal means for eliminating article spillover during the deflashing operation as well as facilitating ease in removal and insertion of the article basket within the deflashing chamber.

23 Claims, 3 Drawing Sheets

Fig. 6
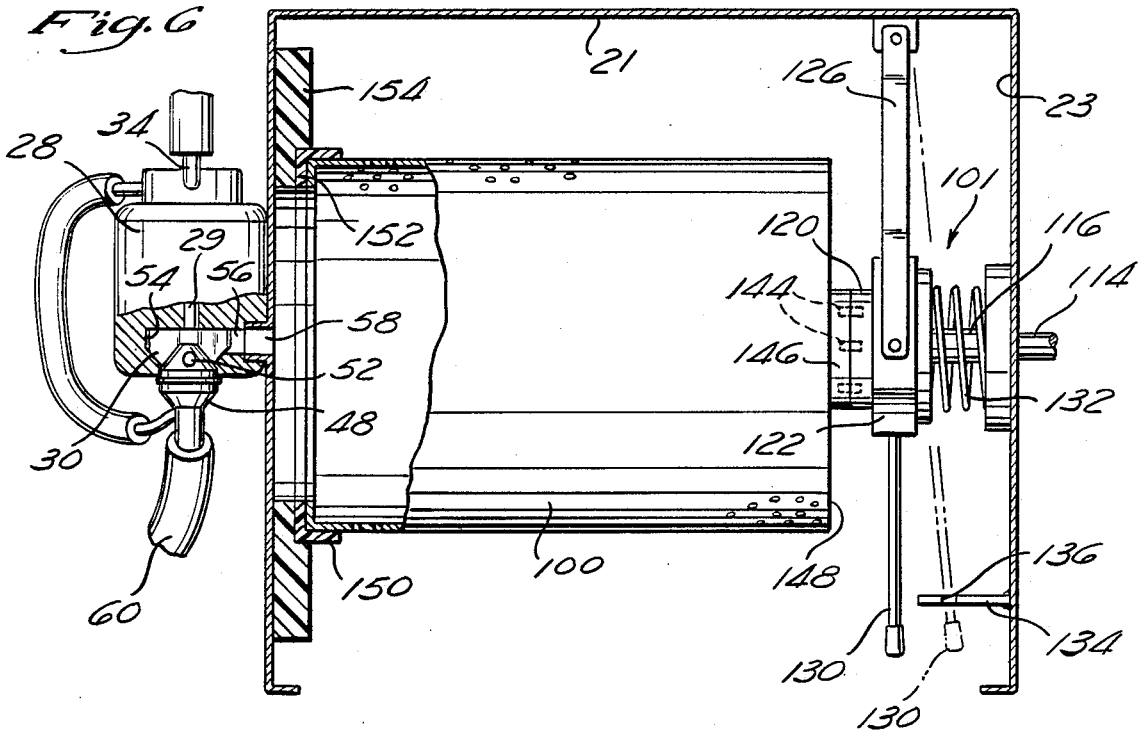
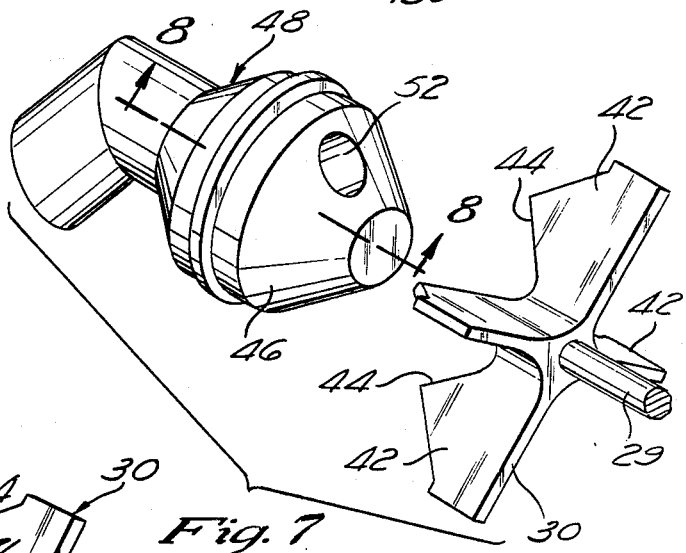
Fig. 7
Fig. 9
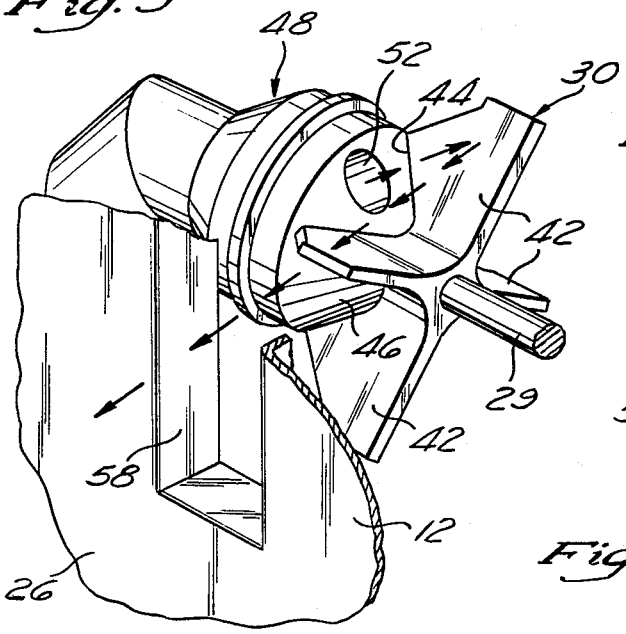
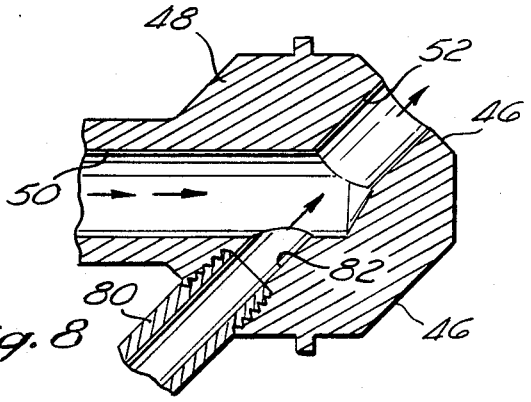
Fig. 8

CRYOGENIC DEFLASHING APPARATUS AND METHOD OF USE

FIELD OF THE INVENTION

The present invention relates generally to deflashing apparatus and systems, and more particularly to a cryogenic deflashing apparatus adapted to rapidly remove residual flash from molded articles. Although not by way of limitation, the present invention is specifically directed toward the removal of residual flash from relatively small-sized molded articles, such as medical apparatus parts, microelectronic parts, and precision elastomeric parts such as O-rings and the like.

BACKGROUND OF THE INVENTION

As is well known, numerous articles of manufacture are molded from various elastomeric rubber and plastic materials. In such molding processes, there oftentimes exists residual material or flash formed on the articles at their part lines, i.e. the area adjacent the interfacing mold surfaces. Such residual flash is not only aesthetically objectionable, but additionally functionally objectionable, and therefore must be removed, i.e. deflashed, from the article prior to use of the same.

Heretofore, it has been customary practice to deflash such articles by hand, requiring the severing of the flash from the article by way of a knife or razor. Such hand deflashing process is costly due to the substantial labor time required to be expended to properly trim the particular article. Furthermore, in some instances it is difficult if not impossible to accomplish a satisfactory deflashing operation as where a particular molded article configuration prohibits manual access to the flash. As a articles is oftentimes substantially increased above actual molding production costs due to the high costs involved with deflashing procedures.

As a consequence of such high deflashing costs, in recent years, cryogenic deflashing apparatus have been introduced into the marketplace which in many instances have eliminated the requirement of costly hand trimming of residual flash from molded rubber and/or plastic manufactured articles. Basically such prior art cryogenic deflashing apparatus comprise a chamber maintained at an extremely low temperature by use of a cryogen gas such as nitrogen into which is introduced a high velocity stream of blasting media typically comprising plastic pellitized shot. The molded articles to be deflashed, such as O-rings, grommets, bushings, and the like, are emplaced within the deflashing chamber wherein, due to the relatively greater thickness of the molded article compared to the residual flash thereon, only the residual flash becomes embrittled in the low temperature environment. In its embrittled state, the residual flash is rapidly separated from or broken off of the molded article by the impact of the high velocity blasting media stream. By controlling the exposure duration of the molded articles within the cryogenic environment, as well as the velocity and dispersion of the deflashing media thereagainst, it has been found that satisfactory article deflashing may be accomplished, typically at a substantial reduction over hand deflashing operations.

Although such prior art cryogenic deflashing apparatus have generally proven to be superior over hand deflashing operations, they have possessed inherent deficiencies which have detracted from their widespread use in the trade. Foremost of these deficiencies has been the relatively large size and cost heretofore associated with such apparatus. In this regard, to insure continuous transport of media to the throwing wheel and thereby insure proper deflashing operations, it has been customary for prior art cryogenic deflashing apparatus to include complicated feed hopper/transport auger mechanisms to convey the blasting media to the throwing wheel. The use of such feed hopper/auger transport mechanisms has necessarily increased the overall size and cost of the apparatus and has mandated that large amounts of deflashing media be maintained within the apparatus, i.e. sufficient amounts to fill the hopper and auger conduit. Further, since the media accumulates spent flash removed in the deflashing process, the requirement of large amounts of media in such deflashing apparatus has additionally required the use of expensive media/flash separation units to be incorporated into the apparatus or alternatively the replacement of large amounts of blasting media during prolonged operation. Additionally, the use of such feed hopper/auger/separating systems in the prior art have proven to be prone to mechanical failure, thereby increasing maintenance costs for the apparatus.

In addition, conventional cryogenic deflashing apparatus have typically proven defective in preventing spillover, i.e. loss, of molded articles within the deflashing chamber during the deflashing operation. Such spillover problems arise primarily upon impact of the molded articles with the blasting media, whereby the molded articles are thrown out of the article basket and enter into the blasting media transport mechanism. As such it has not been uncommon for a relatively large percentage of molded articles to be lost during the cryogenic deflashing process, thereby reducing overall cost effectiveness of the same.

Further, due to the cost and size limitations of the prior art, most cryogenic deflashing apparatus have required dedicated production space to be provided for the apparatus as well as have required permanent hardwire electrical service to the same. As such, the prior art cryogenic deflashing apparatus have proven to be immobile and non-transportable to a particular job location to increase overall production efficiency.

SUMMARY OF THE PRESENT INVENTION

These as well as other deficiencies of the prior art are specifically addressed and alleviated by the present invention. More particularly, the present invention comprises a cryogenic deflashing apparatus specifically adapted to rapidly remove residual flash from molded articles and particularly relatively small-sized molded articles.

In the preferred embodiment, the cryogenic deflashing apparatus of the present invention comprises a readily transportable apparatus which is preferably formed having a double wall, insulated stainless steel housing. The cryogenic deflashing apparatus of the present invention incorporates a novel throw wheel assembly formed as a pump to create a vacuum which is utilized to continuously recirculate blasting media from the sump of the deflashing chamber back to the intake of the throw wheel assembly. The throw wheel assembly is powered by a pneumatic motor, the exhaust of which is supplied to the intake port of the throw wheel to perform a tuborcharging effect to pre-accelerate the blasting media onto the throw wheel and subsequently into the deflashing chamber. This particular turbo-assist feature of the present invention additionally serves to supplement the vacuum assist utilized to transport the blasting media to the intake of the throw wheel to insure consistent input of blasting media to the throw wheel even during low speed throw wheel operation. Although particularly suited for transporting deflashing media in a cryogen environment, the throw wheel assembly is applicable to other media transport and acceleration systems unrelated to cryogenic environments and deflashing applications.

Additionally, the cryogenic deflashing apparatus of the present invention incorporates a novel article basket drive and basket seal arrangement which positively prevents overspill of molded articles from the article basket during the deflashing operation and isolates the drive motor from cryogenic environment exposure. As such, repair and maintenance costs over conventional cryogenic deflashing apparatus are substantially reduced.

To aid in insertion and removal of the article basket from the deflashing chamber, the basket drive mechanism additionally incorporates a spring biased extractor mechanism which further serves to provide a continuous biasing force to maintain the dynamic seal formed upon the open end of the article basket within the deflashing chamber. To accommodate varying marketplace demands, the article basket may be provided having differing perforation sizes suitable for differing molded article deflashing applications.

In the preferred embodiment, the cryogenic deflashing apparatus of the present invention is formed as a compact, table top unit and operates with only two moving part systems, i.e. the throw wheel assembly and the basket drive mechanism. Further, in the preferred embodiment the cryogenic deflashing apparatus of the present invention incorporates standard 120-volt, 15 amp electrical service and operates utilizing a source of compressed shop air and a small low-pressure liquid nitrogen dewar so as to be transportable as well as insure low nitrogen consumption and low power usage.

DESCRIPTION OF THE DRAWINGS

These as well as other features of the present invention will become more apparent upon reference to the drawings wherein:

FIG. 6 is a partial cross-sectional view taken about line 6—6 of FIG. 5 illustrating the dynamic seal formed between the open end of the article basket and the deflashing chamber;

FIG. 7 is a perspective view depicting the throw wheel impeller and input tube of the throw wheel mechanism of the present invention;

FIG. 8 is a cross-sectional view taken about line 8—8 of FIG. 7 and illustrating the input throat of the input tube and the turbo-assist for the same; and FIG. 9 is a perspective view of the input tube and impeller assembly disposed adjacent the deflashing chamber with the arrows depicting blasting media thrown from the throw wheel into the deflashing chamber.

DETAILED DESCRIPTION OF THE PREFERRED EMBODIMENT

Figure 1:
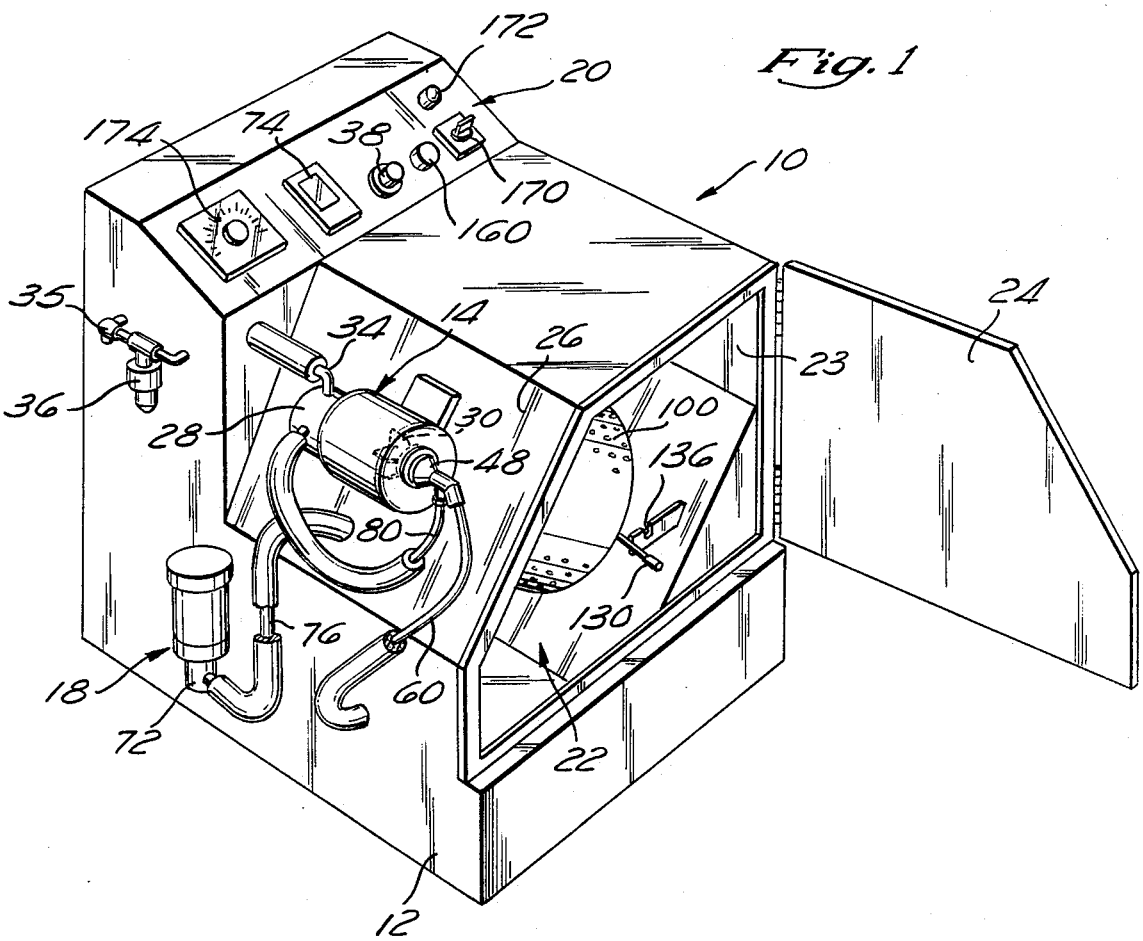
FIG. 1 is a front perspective view of the cryogenic deflashing apparatus of the present invention with the deflashing chamber access door being disposed in an opened orientation.
Figure 2:
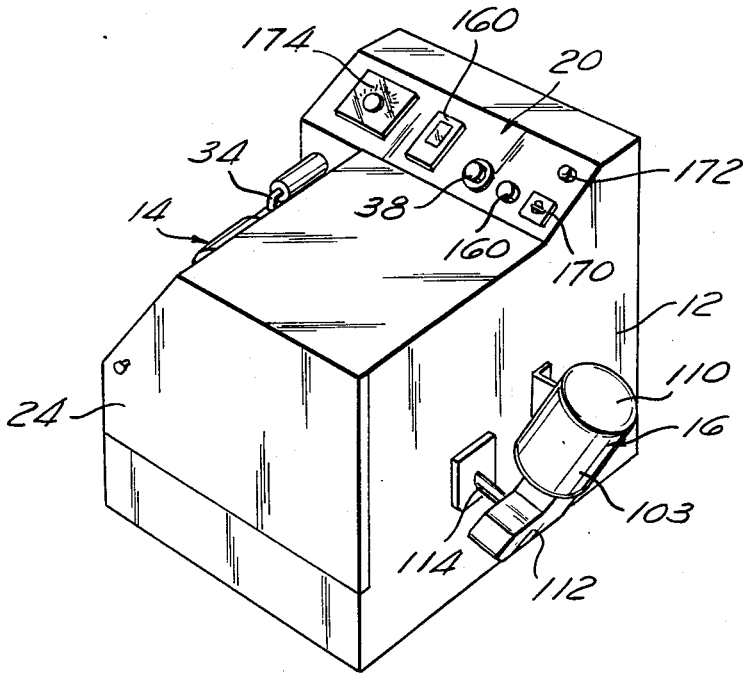
FIG. 2 is a rear perspective view of the cryogenic deflashing apparatus, of the present invention with the deflashing chamber access door being disposed in a closed orientation.

Referring to FIGS. 1 and 2, the cryogenic deflashing apparatus 10 of the present invention is depicted composed generally of a housing 12, throw wheel mechanism or assembly 14, article basket drive mechanism 16, cryogen gas storage system 18, and control panel 20. The housing 12 is preferably formed having a spaced double walled, stainless steel construction including a polyurethane foam thermal insulating core disposed therebetween. The housing 12 defines an interior cavity or deflashing chamber 22 therewithin, and includes a pivotally mounted access panel or door 24 to provide ingress and egress to the deflashing chamber 22. Although by way of example and not limitation, in the preferred embodiment, the housing 12 has an approximate dimension of 19 inches wide, 21 inches deep, and 26 inches high, and as such comprises a table top unit which can be utilized in restricted physical space applications.

The throw wheel mechanism 14 is preferably mounted to the exterior of the housing 12 upon an angularly inclined surface 26 thereof. In the preferred embodiment, the throw wheel mechanism 14 is composed of a fluidic, i.e. pneumatic, motor 28, the output shaft of which 29 drives an impeller or throw wheel 30 (shown in FIGS. 6, 7, and 9). The pneumatic motor 28 receives a supply of compressed fluid, i.e. dry, shop air (not shown) through input conduit 34 which additionally includes a conventional water trap 36 thereon. The rotational speed of the pneumatic motor 28 is controlled by a manually adjustable pressure valve 38 connected to the conduit 34 and disposed upon the control panel 20. In the preferred embodiment, when utilizing shop compressed air at 100 psig at 15 cfm, the rotational speed of the output shaft 29 of the pneumatic motor may be varied between 100 to 10,000 revolutions per minute by selected adjustment of the valve 38.

Referring more particularly to FIGS. 6, 7, and 9, it may be seen that the throw wheel or impeller 30 comprises a star-shaped member having plural vanes 42 extending radially outward from its central axis. Although the impeller may be formed from any low temperature compatible material, in the preferred embodiment, the impeller 30 is formed of an extruded aluminum material thereby being conducive to mass production techniques and is rigidly mounted to the output shaft 29 of the pneumatic motor 28. The central distal edges 44 of the vanes 42 are formed having an angular inclination complementary to an angular frusto-conical shaped surface 46 formed on the end of a input tube 48 of the throw wheel mechanism. As best shown in FIG. 8, the input tube 48 comprises a generally cylindrical member preferably formed of aluminum having a central flow cavity extending therethrough defined by an axially extending flow channel 50 and an angularly extending flow channel 52 which terminates at the beveled surface 46 of the input tube 48.

As best shown in FIG. 6, the impeller 30 and input tube 48 are assembled in a coaxial orientation whereby the distal edges 44 of the vanes 42 are proximate to the frusto-conical shaped beveled surface 46 of the input tube 48 and the impeller 30 and input tube 48 are encased within a throw wheel housing defining a pumping chamber 54 which extends about the impeller 30 and frusto-conical shaped beveled surface 46 of the input tube 48. A discharge opening or outlet 56 is provided through the throw wheel housing which is aligned with a rectangular slot 58 formed through the angular inclined panel 26 of the housing 12 and extending into the deflashing chamber 20.

As will be recognized, upon rotation of the impeller 30 relative the stationary input tube 48 and pumping chamber 54, the distal edges 44 of the impeller 30 wipe against the frusto-conical shaped beveled surface 46 of the input tube and thereby form a mechanical pump whereby a vacuum is drawn through the angular flow channel 52 and axial flow channel 50 in a direction indicated by the arrows in FIG. 8. As will be explained in more detail infra, this vacuum serves to draw blasting media from the interior of the deflashing chamber 20 for subsequent acceleration upon impact by the impeller 30 and final introduction into the deflashing chamber 20.

As best shown in FIG. 1, the distal end of the input tube 48 is rigidly connected to a media transfer tube or conduit 60 positioned on the exterior surface of the housing 12. The opposite end of the conduit 60 extends through the housing 12 so as to be disposed within the interior of the deflashing chamber 20 adjacent its lower region, i.e. sump. As such, blasting media or shot disposed within the lower region or sump of the deflashing chamber 20 may be transported by the vacuum created by the rotation of the impeller 30 through the media transfer conduit 60 and into the axial flow channel 50 and angular flow channel 52 of the input tube 48.

Figure 3:
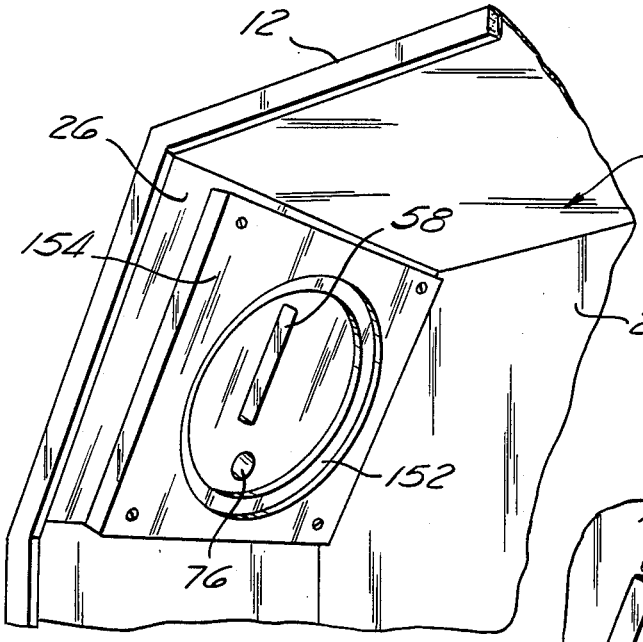
FIG. 3 is a partial perspective view depicting the upper interior surfaces of the deflashing chamber illustrating the throw wheel exit port, nitrogen port, and article basket registering and seal means formed thereon.

The cryogen gas storage system 18 generally comprises a cryogen gas dewar (not shown) containing a cryogen gas, such as liquid nitrogen, which is positioned adjacent the exterior of the housing 12. The dewar is connected via suitable tubing or conduits to a conventional cryogen valve 72, the operation of which is controlled by a temperature controller 74 disposed upon the control panel 20. A conduit 76 extends from the valve 72 on the exterior of the housing 12 and through the angular panel 26 of the housing terminating within the interior of the deflashing chamber 20 (as shown in FIG. 3). In the preferred embodiment, the temperature controller 74 comprises a conventional digital temperature controller with a set point and actual temperature display, with the temperature existing within the deflashing chamber 20 being sensed by a thermocouple (not shown) disposed within the interior of the deflashing chamber 20. As such, it will be recognized, that via the temperature controller 74, a supply of cryogen gas is periodically transported from the dewar through the valve 72 and conduit 76, and into the interior the deflashing chamber 20.

It is an important feature of the present invention that the exhaust from the pneumatic motor 28 is utilized to pre-accelerate blasting media onto the impeller 30 as well as supplement the vacuum created through the media transfer conduit 60. This beneficial result is achieved by supplying the exhaust from the pneumatic motor 28 through a motor exhaust conduit 80 and introducing the same within the flow channels 50 and 52 formed within the input tube 48. As shown in FIG. 8, the conduit 80 is rigidly connected to an input port 82 formed within the input tube 48. Preferably, the port 82 is coaxial with the angular flow channel 52 formed within the input tube 48 such that exhaust gas from the pneumatic motor 28 extends through the port 82 and angular flow channel 52 in a direction indicated by the arrows in FIG. 8. As the exhaust gas flows through the port 82, media particles traveling through the axial flow channel 50 are accelerated by the gas flow through the angular flow channel 52 in a turbocharging effect. This particular turbocharging effect has been found to substantially increase the speed of blasting media exiting the throw wheel assembly 16. Further, it will be recognized that the introduction of the exhaust gas through port 82 and angular flow channel 52 forms a venturi effect which serves to increase the amount of vacuum developed within the axial flow channel 50 of the input tube 48, which increase in vacuum serves to supplement the vacuum lift existing within the media transfer conduit 60 even during low rotational speed of the impeller 30.

Referring more particularly to FIGS. 2, 4, 5, and 6, the detailed construction of the article basket drive mechanism 16 may be described. By way of overview, the article basket drive mechanism 16 includes an article basket 100, a basket extraction mechanism designated generally by the numeral 101, and a basket rotating mechanism designated generally by the numeral 103 (in FIG. 2). The article basket 100 is preferably formed as a cylindrical stainless steel container having perforated walls, which is sized to receive molded articles to be deflashed therewithin. The basket extraction mechanism 103 allows rapid insertion and removal of the article basket 100 from the deflashing chamber 20. The basket rotating mechanism 103 rotates the article basket 100 about it's central axis to cause the molded articles to be tumbled within the basket 100, thereby insuring that all of the molded articles to be deflashed are exposed to the blasting media being thrown by the throw wheel mechanism 14 within the deflashing chamber 20.

Figure 4:
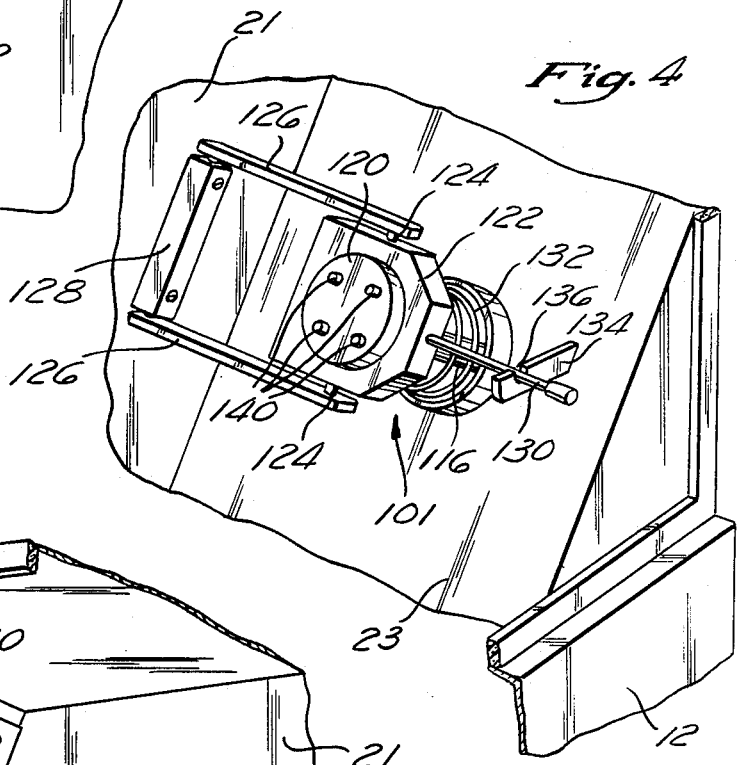
FIG. 4 is a perspective view of the article basket extractor mechanism and article basket drive mechanism disposed within the interior of the deflashing chamber.
Figure 5:
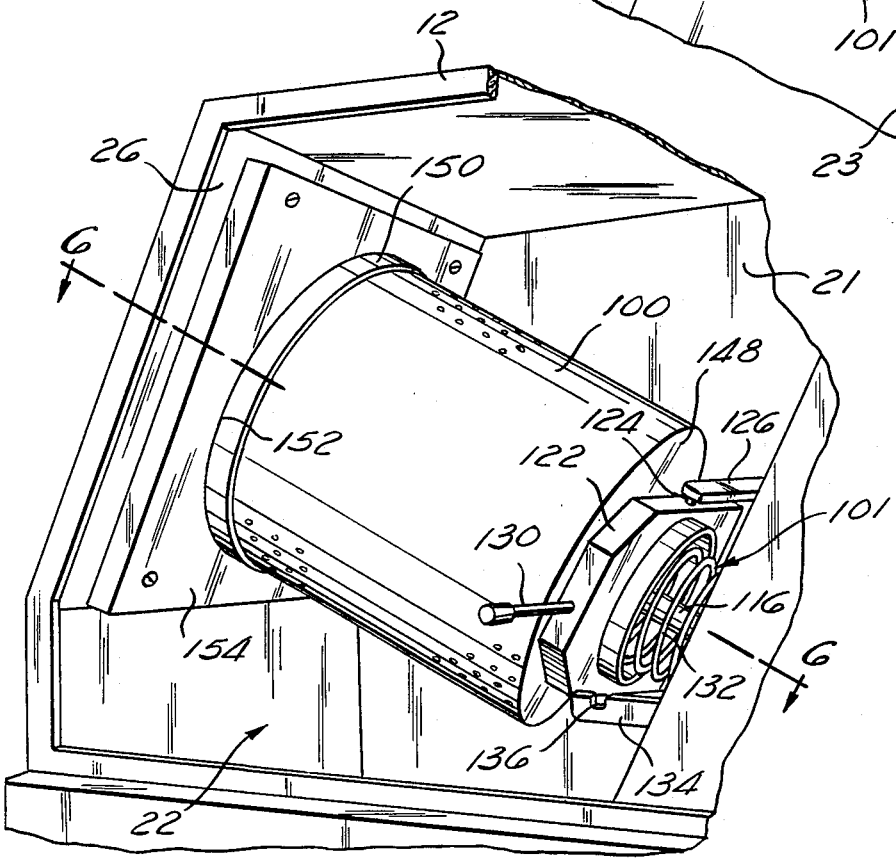
FIG. 5 is a perspective view of the interior of the deflashing chamber with the article basket disposed within the deflashing chamber and engaged with the basket drive mechanism.

The basket rotating mechanism 103 comprises an electric motor 110 which is rigidly mounted on the exterior of the housing 12. The output shaft of the motor 110 cooperates with a gear reduction unit or transmission 112 having an output shaft 114 which extends through the housing 12 into the interior of the deflashing chamber 20. The output shaft 114 includes a spline and is engaged with a basket drive shaft 116 disposed within the interior of the deflashing chamber 20. The spline connection between the output shaft 114 and basket drive shaft 16 allows moderate axial reciprocation of the basket drive shaft 116 along the length of the output shaft 114 while causing simultaneous rotation of the shafts 114 and 116. The distal end of the basket drive shaft 116 is connected to a cylindrical drive hub 120 which is journaled for rotational movement upon a yoke member 122. The yoke member 122 is mounted by a pair of axles 124 to a pair of support arms 126 which extend laterally from the rear wall 21 of the deflashing chamber 20. As best shown in FIG. 4, both support arms 126 are pivotally attached to a mounting block 128 depending from the rear wall 21 of the deflashing chamber 20. An elongate handle 130 is rigidly attached to the yoke 122 and extends laterally outward therefrom and a coil spring 132 is disposed between the yoke 122 and the interior wall 23 of the deflashing chamber 20. A retainer arm 134 extends outwardly from the interior wall 23 of the deflashing chamber 20 and includes a slot or recess 136 along its upper surface sized to receive the handle 130 therewithin.

The drive hub 120 includes plural lugs or pins 140 extending outwardly from its upper surface which mate with complementary-shaped recesses 144 (shown in phantom lines in FIG. 6) extending axially outward from a flange 146 mounted on the lower closed end 148 of the article basket 100. The opposite end of the article basket 100 is provided with a generally L-shaped circumferential flange 150 which extends a short distance over the open end of the article basket 100 as well as downwardly along its axial length. In the preferred embodiment, the flange 150 is formed of a high molecular weight polyethylene material which the applicants have found is highly conducive to withstand cryogenic environments. The flange 150 is received within an annular recess 152 formed on a bearing block or plate 154 rigidly mounted within the interior of the deflashing chamber 20 upon the inside surface of the angular housing wall 26. In the preferred embodiment, the bearing plate 154 is additionally formed of a high molecular weight polyethylene material and the diameter of the recess 152 is sized to be slightly greater than the maximum diameter of the flange 150. As such, when the flange 150 is disposed within the recess 152, the article basket 100 is axially registered with the recess 152 and with the article basket drive shaft 116. Further, a dynamic, i.e. rotational, seal is formed between the flange 150 and bearing plate 152 which serves to prevent any molded article spillover from the interior of the article basket 100 during the deflashing operation.

The motor 110 is controlled by a potentiometer 160 disposed upon the control panel 20. As will be recognized, during activation of the motor 110 by the potentiometer 160, output shaft 114 is rotated causing a corresponding rotational movement of the article basket drive shaft 116 and hub 120. Due to the engagement of the lugs 140 of the hub 120 within the plural recesses 144 of the flange 146, rotational movement of the hub 120 additionally causes rotational movement of the article basket 100 within the deflashing chamber 20. As such, molded articles contained within the interior of the article basket 100 are tumbled therein at a rotational speed determined for the particular deflashing application and controlled by the potentiometer 160.

The control panel 20 additionally includes a conventional on/off power switch 170 and power on light 172 as well as a conventional cycle timer 174 operative to provide automatic operation of the throw wheel assembly 14, article basket drive wheel mechanism 16, and cryogen gas storage system 18 on timed production cycles.

With the structure defined the operation of the cryogenic deflashing apparatus 10 of the present invention may be described. Initially, the apparatus 10 is placed upon a support surface and the electrical power cord (not shown) of the apparatus 10 may be plugged into a standard 120-volt, 15-amp grounded electrical line. A source of compressed dry shop air (not shown) may then be attached to the coupling 35 disposed upon the exterior of the housing 12 and upstream of the water trap 36. A filled dewar of cryogen gas, preferably nitrogen, may then be connected to the valve 72 of the cryogen gas storage system 18. Subsequently, the access door 24 may be disposed into its open configuration, as depicted in FIG. 1, and a quantity of conventional blasting media may be inserted within the interior of the deflashing chamber 20. In contradistinction to conventional systems, the apparatus 10 requires an extremely small quantity of blasting media, i.e. approximately 1 liter, as opposed to conventional systems which require approximately 50 pounds of media. This substantial reduction in media requirements is due primarily to the elimination of the prior art storage hopper and auger media transport systems which necessarily required substantial media volume to deliver continuous amounts of media to the throw wheel assembly.

The article basket 100 may be removed from the interior of the deflashing chamber 20 by manually grasping the handle 130 formed on the basket extraction mechanism 101 and urging the same in a direction from left to right, as viewed in FIG. 6. As will be recognized, due to the spline connection between the basket drive shaft 116 and output shaft 114, as well as the pivotal connection of the support arms 126 with the mounting block 128, this left to right movement of the handle 130 allows the yoke 122, support arms 126, and handle 130 to pivot about the mounting block 128 from its full line position to its phantom line position, shown in FIG. 6, whereby the coil spring 132 is compressed from its initial axial length. To maintain the retracted position of the yoke 122 relative the article basket 100, the handle 130 may be inserted within the recess 136 formed on the retainer arm 134. With the yoke 121 spaced from the lower end 148 of the article basket 100, the article basket 100 may then be axially reciprocated such that its flange 150 is disengaged from the recess 152 whereby the basket 100 can be removed from the interior of the deflashing chamber 20.

Depending upon the particular desired deflashing operation, the perforation size of the article basket 100 is selected to insure that the molded articles disposed therein cannot extend through the perforations, yet the blasting media may readily extend therethrough. In this regard, it is specifically contemplated that multiple article baskets 100 will be inventoried for the apparatus 10 to allow diversity in the deflashing operations carried out on the apparatus 10. When the appropriate article basket 100 is selected, the molded articles (not shown) desired to be deflashed are inserted within the interior of the article basket 100 and the basket 100 is then positioned within the deflashing chamber 20. The flange 150 formed on the open end of the article basket 100 may then be inserted within the recess 152 formed on the bearing block 154 whereby the article basket 100 is axially registered with the basket rotating mechanism 103. Subsequently, the handle 130 may be released from engagement with the recess 136 formed on the retainer arm 134 whereby the coil spring 160 urges the yoke 122 and handle 130 from its phantom line position to its full line position, shown in FIG. 6. In its full line position, the plural drive lugs 140 formed on the drive hub 120 may be inserted within the complementary formed apertures 144 formed on the lower flange mount 146 of the basket 100 to mechanically couple the article basket 100 to the basket rotating mechanism 103. Additionally, due to the coil spring 132, a continuous axial biasing force is applied to the article basket 100 thereby insuring that a dynamic seal is maintained between the flange 150 and recess 152 formed on the bearing block 154.

With the molded articles disposed within the deflashing chamber 120, the access door or panel 24 may be returned to its closed orientation, as depicted in FIG. 2, and the main power switch 170 may be turned to it's on position whereby the power-on light 172 is illuminated. Subsequently, the temperature controller 160 may be manually set to the desired cryogenic temperature to be maintained within the deflashing chamber 20 whereby, in response thereto, a suitable supply of cryogen gas is released from the dewar through the valve 72 through conduit 76 and within the interior of the deflashing chamber 20. As best shown in FIG. 3, the location of the distal end of conduit 76 causes the supply of cryogen gas to be released in a generally axial direction directly within the interior of the article basket 100 thereby insuring that the molded articles maintained within the interior of the basket 100 are exposed to the low temperature gas flow. Further, this axial flow of gas serves to conserve cryogen gas consumption by primarily cooling the molded articles maintained within the article basket 100 as opposed to the entire volume of the deflashing chamber.

The article basket drive mechanism 16 may then be activated by manually turning the potentiometer 160 upon the control panel 20, thereby causing the motor 110 to reach a desired rotational speed. As explained supra, rotation of the drive shaft 114 of the mechanism 16 causes a corresponding rotation of the article basket drive shaft 116 whereby the article basket 100 is rotated at the desired speed within the deflashing chamber 20. During this rotation, the peripheral flange 150 formed on the open end of the article basket 100 rides upon the recess 152 formed on the bearing block 154 which, due to the biasing force of the spring 116, forms a dynamic seal preventing any inadvertent overspilling of the molded articles out of the article basket 100.

The throw wheel control knob or valve 38 may then be manually turned, causing the valve 38 to allow a metered flow of compressed air into the pneumatic motor 28, thereby causing rotation of the impeller 30 relative the input tube 48. Due to the throw wheel assembly 14 being formed as a pump, during rotation of the impeller 30, a vacuum is created within the axial flow channel 50 and angular flow channel 52 of the input tube 48, which vacuum is communicated through the media transfer conduit 60 into the lower region, i.e. sump, of the deflashing chamber 20. The magnitude of this vacuum has been found to be sufficient to continuously draw blasting media contained within the sump of the deflashing chamber 20 upwardly through the media transfer tube 60 and into the input tube 48 of the throw wheel assembly 14. As the blasting media is drawn through the axial flow channel 50, it encounters the exhaust air flow from the pneumatic motor 28, which is supplied to the port 82 formed in the input tube 48 via conduit 80. Upon encountering the exhaust air flow, the particles are rapidly accelerated through the angular flow channel 52 in a generally radial or tangential direction to the rotational axis of the impeller 30 and subsequently contact the rotating impeller 30. As the blasting media contacts the vanes 42 of the impeller 30, they are further accelerated by mechanical contact with the impeller vanes 42 and discharged through the rectangular opening 58 to contact the molded articles maintained within the article basket 100. As will be recognized, due to the impeller 30 discharging the blasting media axially within the interior of the article basket 100, the molded articles contained therein are continuously bombarded by the blasting media which, in combination with their tumbling provided by the article basket drive mechanism 16, insures thorough and rapid article deflashing.

As the blasting media is propelled by the throw wheel mechanism 14 within the interior of the article basket 100, the blasting media proceeds through the multiple perforations formed within the article basket 100 and fall back to the lower sump portion of the deflashing chamber 20 so as to be continuously recycled back to the throw wheel assembly 16 via the transfer media conduit 60. Additionally, it will be recognized that due to the exhaust from the pneumatic motor 28 being supplied to the input tube 48, the blasting media particles are pre-accelerated into the impeller 30 which the applicants have found increases the velocity of the discharged blasting media from the throwing wheel assembly by a magnitude of approximately two-fold. Finally, it will be recognized that the amount of vacuum developed through the axial and angular flow channels 50 and 52, respectively, of the input tube 48 and through the media transport conduit 60, is dependent upon the rotational speed of the impeller 30 across the angular flow channel 52. As such, in relatively low rotational speed applications of the impeller 30, the use of the exhaust flow from the pneumatic motor 28 into the input tube 48 serves to supplement the amount of vacuum developed within the axial flow channel 50 and media transport conduit 60 to insure a continuous supply of media to the impeller 30. As such, the throw wheel mechanism 14 of the present invention provides a turbo-charging affect wherein blasting media is pre-accelerated into contact with the rotating impeller 30 as well as provides a supplemental transport force which augments the continuous transport of blasting media to the impeller even during low rotational speed of the impeller.

When the molded articles have had a sufficient residence time within the deflashing chamber 20 so as to be thoroughly deflashed by the deflashing media, operation of the throw wheel mechanism 14, article basket drive mechanism 16, and cryogen gas storage system 18 may be discontinued, whereby the access panel 24 may be opened and the article basket 100 may be removed by articulation of the basket extraction mechanism in a manner previously described. Subsequently, additional deflashing operation may be effectuated in the manner previously described.

For continuous production run batches, the automatic cycle timer 174 may be preset as desired to enable time sequentual batch operation of molded articles within the deflashing apparatus 16. Further, after continuous operation, the apparatus 10 of the present invention is specifically adapted to allow rapid removal of the blast media from the interior of the deflashing chamber 20, as by way of a vacuum, and subsequent refilling with new media which is not contaminated by flash removed in the deflashing process.

Although for purposes of illustration certain part configurations, materials, and sizes have been disclosed herein, those skilled in the art will recognize that various modifications to the same can be made without departing from the spirit of the present invention and such modifications are clearly contemplated herein. Additionally, although the throw wheel mechanism 14 has been described with specific use in relation to cryogenic deflashing apparatus, those skilled in the art will recognize that the throw wheel mechanism 16 additionally has utility in transporting and projecting blasting media in non-cryogenic environments and such additional uses of the throw wheel assembly 14 are clearly contemplated herein.

What is claimed is:

1. A cyrogenic deflashing apparatus for removing residual flash from molded articles comprising:

a housing defining a deflashing chamber therein;

a basket disposable within said deflashing chamber sized to receive a quantity of molded articles to be deflashed therein;

means for rotating said basket within said deflashing chamber to tumble said quantity of molded articles within said basket;

means for supplying a cryogen gas within said deflashing chamber; and a fluidic-assisted throw wheel pump means for accelerating deflashing media into said basket to deflash said molded articles disposed within said basket, said fluidic-assisted throw wheel pump means comprising:

a pump chamber having an inlet and an outlet;

an impeller rotatably mounted within said pump chamber;

a fluidic-driven motor coupled to said impeller for rotating said impeller within said pump chamber; and means for supplying the exhaust from said fluidic-driven motor to said inlet of said pump for preaccelerating said deflashing media.

2. The cyrogenic deflashing apparatus of claim 1 further comprising a conduit extending from said deflashing chamber to the inlet of said pump chamber for transporting deflashing media from said deflashing chamber to said impeller.

3. The cyrogenic deflashing apparatus of claim 2 wherein said fluidic-driven motor comprises a pneumatic motor.

4. The cyrogenic deflashing apparatus of claim 3 further comprising means for varying the rotational speed of said pneumatic motor.

5. The cyrogenic deflashing apparatus of claim 3 wherein said basket is formed having a closed bottom end and an open top end including means for forming a dynamic seal between said open top end and said housing to prevent said molded articles from exiting said basket during deflashing of said molded articles.

6. The cyrogenic deflashing apparatus of claim 5 wherein said dynamic seal means comprises a peripheral flange disposed adjacent the open top end of said basket which is received within a complementary-shaped recess formed on a bearing block mounted to said housing within said deflashing chamber.

7. The cyrogenic deflashing apparatus of claim 6 wherein said peripheral flange and said bearing block is formed of a high molecular weight polyethylene material.

8. The cyrogenic deflashing apparatus of claim 5 wherein said means for rotating said basket comprises:

a motor disposed on the exterior of said housing;

a drive shaft driven by said motor and extending through said housing into said deflashing chamber; and a hub mounted to said drive shaft and engageable with the closed bottom end of said basket.

9. The cyrogenic deflashing apparatus of claim 8 further comprising means for varying the position of said hub within said deflashing chamber to enable said basket to be inserted and removed from said deflashing chamber.

10. The cyrogenic deflashing apparatus of claim 9 wherein said hub position-varying means comprises:

a yoke rotatably mounted to said hub;

means extending from said housing to said yoke for pivotally supporting said yoke in a first pivotal position wherein said hub engages said closed bottom end of said basket and a second pivotal position wherein said hub is spaced from said closed bottom end of said basket; and means disposed between said housing and said yoke for biasing said yoke toward said first pivotal position.

11. The cyrogenic deflashing apparatus of claim 10 wherein said biasing means comprises a spring positioned about said drive shaft.

12. The cyrogenic deflashing apparatus of claim 11 further comprising means for selectively maintaining said yoke in said second pivotal position.

13. The cyrogenic deflashing apparatus of claim 12 further comprising means for varying the rotational speed of said motor.

14. The cyrogenic deflashing apparatus of claim 13 wherein said cryogen gas-supplying means is positioned to supply cryogen gas through said open top end of said basket.

15. A cyrogenic deflashing apparatus for removing residual flash from molded articles comprising:

a housing defining a deflashing chamber therein;

a basket disposable within said deflashing chamber sized to receive a quantity of molded articles to be deflashed therein, wherein said basket is formed having a closed bottom end and an opened top end including means for forming a dynamic seal between said opened top and in said housing to prevent said molded articles from exiting said basket during deflashing of said molded articles, said dynamic seal means comprising a peripheral flange disposed adjacent the opened top end of said basket which is received within a complementary-shaped recess formed on a bearing block mounted to said housing within said deflashing chamber;

means for rotating said basket within said deflashing chamber to tumble said quantity of molded articles within said basket;

means for supplying a cryogen gas within said deflashing chamber;

a fluidic-assisted throw wheel pump means for accelerating deflashing media into said basket to deflash said molded articles disposed within said basket, said fluidic-assisted throw wheel pump means comprising a pump chamber having an inlet and an outlet, an impeller rotatably mounted within said pump chamber, a pneumatic motor coupled to said impeller for rotating said impeller within said pump chamber, and means for supplying the exhaust from said pneumatic motor to said inlet of said pump; and a conduit extending from said deflashing chamber to the inlet of said pump chamber for transporting deflashing media from said deflashing chamber to said impeller.

16. The cyrogenic deflashing apparatus of claim 15 wherein said peripheral flange and said bearing block is formed of a high molecular weight polyethylene material.

17. A cyrogenic deflashing apparatus for removing residual flash from molded articles comprising:

a housing defining a deflashing chamber therein;

a basket disposable within said deflashing chamber sized to receive a quantity of molded articles to be deflashed therein, wherein said basket is formed having a closed bottom end and an opened top end including means for forming a dynamic seal between said opened top end and in said housing to prevent said molded articles from exiting said basket during deflashing of said molded articles;

means for rotating said basket within said deflashing chamber to tumble said quantity of molded articles within said basket, said means for rotating said basket comprising a motor disposed on the exterior of said housing, a drive shaft driven by said motor and extending through said housing into said deflashing chamber, and a hub mounted to said drive shaft and engageable with the closed bottom end of said basket;

means for supplying a cryogen gas within said deflashing chamber;

a fluidic-assisted throw wheel pump means for accelerating deflashing media into said basket to deflash said molded articles disposed within said basket, said fluidic-assisted throw wheel pump means comprising a pump chamber having an inlet and an outlet, an impeller rotatably mounted within said pump chamber, a pneumatic motor coupled to said impeller for rotating said impeller within said pump chamber, and means for supplying the exhaust from said pneumatic motor to said inlet of said pump; and a conduit extending from said deflashing chamber to the inlet of said pump chamber for transporting deflashing media from said deflashing chamber to said impeller.

18. The cyrogenic deflashing apparatus of claim 17 further comprising means for varying the position of said hub within said deflashing chamber to enable said basket to be inserted and removed from said deflashing chamber.

19. The cyrogenic deflashing apparatus of claim 18 wherein said hub position-varying means comprises:

a yoke rotatably mounted to said hub;

means extending from said housing to said yoke for pivotally supporting said yoke in a first pivotal position wherein said hub engages said closed bottom end of said basket and a second pivotal position wherein said hub is spaced from said closed bottom end of said basket; and means disposed between said housing and said yoke for biasing said yoke toward said first pivotal position.

20. The cyrogenic deflashing apparatus of claim 19 wherein said biasing means comprises a spring positioned about said drive shaft.

21. The cyrogenic deflashing apparatus of claim 20 further comprising means for selectively maintaining said yoke in said second pivotal position.

22. The cyrogenic deflashing apparatus of claim 21 further comprising means for varying the rotational speed of said motor.

23. The cyrogenic deflashing apparatus of claim 22 wherein said cryogen gas-supplying means is positioned to supply cryogen gas through said opened top end of said basket.

* * * * *